US012241686B2

(12) United States Patent
Libert et al.

(10) Patent No.: US 12,241,686 B2
(45) Date of Patent: Mar. 4, 2025

(54) AIR-COOLED STEAM CONDENSER WITH IMPROVED SECOND STAGE CONDENSER

(71) Applicant: Evapco, Inc., Taneytown, MD (US)

(72) Inventors: Jean-Pierre Libert, Taneytown, MD (US); Mark Huber, Taneytown, MD (US)

(73) Assignee: Evapco, Inc., Taneytown, MD (US)

( * ) Notice: Subject to any disclaimer, the term of this patent is extended or adjusted under 35 U.S.C. 154(b) by 243 days.

(21) Appl. No.: 17/887,711

(22) Filed: Aug. 15, 2022

(65) Prior Publication Data

US 2023/0051944 A1 Feb. 16, 2023

Related U.S. Application Data

(60) Provisional application No. 63/232,970, filed on Aug. 13, 2021.

(51) Int. Cl.

| | |
|---|---|
| ***F28B 7/00*** | (2006.01) |
| ***F28B 1/06*** | (2006.01) |
| ***F28B 9/02*** | (2006.01) |
| ***F28D 1/04*** | (2006.01) |
| ***F28F 1/10*** | (2006.01) |

(52) U.S. Cl.

CPC ..... *F28B 7/00* (2013.01); *F28B 1/06* (2013.01); *F28B 9/02* (2013.01); *F28D 1/0408* (2013.01); *F28F 1/10* (2013.01); *F28F 2215/00* (2013.01)

(58) Field of Classification Search

CPC ..... F28B 7/00; F28B 1/06; F28B 9/00; F28D 1/024; F28D 1/0408; F28F 1/10; F28F 2215/00; F28C 1/00; F28C 1/04; F28C 1/02

See application file for complete search history.

(56) References Cited

U.S. PATENT DOCUMENTS

| | | | | |
|---|---|---|---|---|
| 11,604,030 | B2 * | 3/2023 | Singh | F28B 9/02 |
| 2008/0006395 | A1 | 1/2008 | Sanderlin et al. | |
| 2019/0242660 | A1 | 8/2019 | Badin et al. | |
| 2020/0080785 | A1 * | 3/2020 | Bugler | F28D 1/05366 |

FOREIGN PATENT DOCUMENTS

| | | |
|---|---|---|
| CN | 112539174 | 3/2021 |

OTHER PUBLICATIONS

International search report in international appln. No. PCT/US2022/40310 dated Jan. 25, 2023.

* cited by examiner

*Primary Examiner* — Len Tran

*Assistant Examiner* — Kamran Tavakoldavani

(74) *Attorney, Agent, or Firm* — Whiteford, Taylor & Preston, LLP; Peter J. Davis

(57) ABSTRACT

Large scale field erected air cooled industrial steam condenser having heat exchanger panels with primary and secondary condenser sections, in which the secondary condenser section comprises 10% or less of the total heat exchanger, and in which the tubes of the primary condenser sections have narrowed outlet orifices having an area that is 50% or less than the cross-sectional area of a corresponding tube. The invention permits the reduction of secondary condenser tubes while reducing the outlet header pressure sufficiently to minimize backflow, sweep non-condensables and prevent the formation of dead zones.

9 Claims, 21 Drawing Sheets

SECTION B-B

DETAIL A

AIR-COOLED STEAM CONDENSER WITH IMPROVED SECOND STAGE CONDENSER

BACKGROUND OF THE INVENTION

Field of the Invention

The present invention relates to large scale field erected air cooled industrial steam condensers.

Description of the Background

Due to the decreasing availability and rising cost of cooling water, direct air-cooled steam condensers (ACC) are used instead of indirect evaporative cooling towers to dissipate heat into the environment in power plants that incorporate steam turbines.

In a direct ACC, the steam exiting a steam turbine is fed via a turbine exhaust duct and steam duct manifolds to a set of primary condenser tubes (first stage condenser). Residual steam leaving the primary condenser tubes is then condensed in a set of secondary condenser tubes (second stage condenser, dephlegmator or reflux condenser). Second stage, or secondary, condenser tubes minimize backflow, which is flow from the outlet manifold of the primary tubes into the intended outlet of a fraction of the primary tubes. Backflow is caused by a pressure variation among the primary tubes. Tubes with higher outlet pressures raise the outlet manifold to a pressure greater than that of tubes with lower outlet pressures. This causes vapor to flow from the outlet manifold into those tubes with lower outlet pressures. When backflow occurs in a primary tube, the tube effectively has two vapor inlets and no vapor outlet path for the non-condensable gases, which accumulate into a pocket or dead zone. The formation of dead zones in condenser tubes reduces the capacity of the ACC to condense steam and may subject the condensate in the tubes to freeze.

Located downstream of the primary condenser tubes outlet manifold in the steam path, the secondary condenser tubes enable additional vapor flow through the primary condenser tubes, which increases the pressure drop through the primary tubes and reduces the outlet manifold pressure. Greater pressure variations among the primary tubes are required to cause backflow when the outlet manifold pressure is reduced. Therefore, a two-stage condenser is more resistant to pressure variations and the formation of dead zones. The secondary condenser tubes collect non-condensable gases from the primary tubes to be separated out and typically vented to atmosphere through an air-removal system consisting in vacuum pumps or steam jet air ejectors, or both.

An ACC is typically arranged in rows or streets of modules or cells, each in line with the steam distribution manifolds. Several rows or streets may be arranged adjacent one-another to form a rectangular array of cells or modules. Each row or street incorporates primary condenser tubes and secondary condenser tubes, either in separate cells or modules, or interspersed among them. HEI Standard states in section 2.29 that "the second stage cell collects the remaining steam and the non-condensables and is connected with the air-removal system at the top and the condensate header at the bottom. It is also referred to as a Dephlegmator, Secondary or Reflux cell."

According to K Wilber and K Zammit (EPRI's ACC Guideline), "The total number of cells or modules is the sum of the Primary and Secondary Modules. The Primary Modules are responsible for the majority of the heat transfer and condensing, while the Secondary Cells are responsible for residual heat transfer and non-condensable collection and evacuation. ( . . . ) The number of Primary Modules is typically about 80 percent of the total number of modules. ( . . . ) The number of Secondary Modules is typically about 20 percent of the total number of modules and there is typically one module per row (or street)."

Owen (Stellenbosch University, Air-cooled steam condensers) investigated "the steam-side operation of a practical air-cooled steam condenser using a combination of CFD, numerical, analytical and experimental methods," while directing particular attention "towards the vapor flow distribution in the primary condensers and dephlemator performance." Owen demonstrated that "The vapor flow in the primary condensers is shown to exhibit a non-uniform distribution amongst the heat exchanger tubes. ( . . . ) The non-uniform flow distribution places an additional demand on dephlegmator performance, over and above the demands of row effects in the case of multi-row primary condenser bundles." Owen focused his investigation on the effects of multiple-row condenser bundles and the influence of transverse variations in tube inlet loss coefficients. Owen further concluded that "The use of single-row primary condenser bundles holds the greatest potential for reducing the demands on the dephlegmator. By eliminating the row effect in the primary condensers, dephlegmator loading can be reduced by up to 70%. The resultant large margin of safety to cope with non-ideal operation is highly desirable in light of the well documented negative effects of wind on fan performance and recirculation at large ACCs."

SUMMARY OF THE INVENTION

Our own experiments have demonstrated that, even with single-row condenser tube bundles, non-uniform distribution of vapor flow in the primary condenser tubes and resulting pressure variations occur as the result of variations of face air velocity between the heat exchanger tubes and the effect of wind gusts over the face of the heat exchangers, among the external parameters that affect the condensing capacity of the ACC. These non-ideal operating conditions place a burden on the secondary condenser tubes, which would lead the person of ordinary skill in the art to improve it by increasing the proportion of secondary condenser tubes. However, we have discovered that as the proportion of secondary tubes increases, the proportion of primary tubes decreases leading to a corresponding increase in the steam velocity and steam side pressure drop in the primary tubes. The increase in pressure drop and associated reduction in condensing temperature reduces the thermal performance, or condensing capacity of the ACC, particularly at low pressure operating conditions. It is therefore of interest to reduce the overall dimensions and cost of the ACC, to maximize the extent of the primary condenser tubes, and to minimize the extent of the secondary condenser tubes.

The invention presented herein is a new and improved design for large scale field-erected air cooled industrial steam condensers for power plants and the like which provides significant improvements and advantages over the ACCs of the prior art. The innovation in this invention is that each primary condenser tube has a cap or plate at its outlet end having a flow orifice, so that each orifice provides a steam-side pressure loss which reduces the outlet manifold pressure and prevents backflow among the primary tubes. The average flowrate through the orifice is determined by the proportion of secondary tubes in the design. The size of the orifice and the proportion of secondary tubes are selected to reduce the outlet manifold pressure to a desired target in order to regulate and balance the vapor flow across the primary condenser tubes, to eliminate the risk of backflow and to prevent the formation of dead zones at the top of the primary condenser tubes.

The primary tube outlet orifices may have an area of less than or equal to one half of the cross-sectional area of the tube itself.

The incorporation of orifices in the outlet end of each primary condenser tube allows to greatly reduce the amount of secondary condenser tubes while reducing the outlet header pressure sufficiently to minimize backflow, sweep non-condensable gases and prevent the formation of dead zones. The secondary condenser tubes allow non-condensable gases to be separated out and vented to atmosphere through the air-removal system.

According to one embodiment of the present invention, heat exchanger panels are constructed with an integral secondary condenser section positioned essentially in the center of the heat exchanger panel, flanked by primary condenser sections which may or may not be identical to one-another. A bottom bonnet runs along the bottom length of the heat exchanger panel, connected to the bottom side of the bottom tube sheet, for delivering steam to the bottom end of the primary condenser tubes. In this arrangement, the first stage of condensing occurs in counter-current operation. The tops of the tubes are connected to a top tube sheet, which in turn is connected on its top side to a top bonnet. See e.g., U.S. Pat. No. 10,982,904, the disclosure of which is incorporated herein in its entirety. According to the present invention, each primary condenser tube incorporates a cap or plate at its top/outlet end, the cap or plate having a narrowed flow orifice. The orifices may be rectangular, round elliptical or round and may have an area of about 50% or less of the cross-sectional area of the tube itself. Uncondensed steam and non-condensables flow into the top bonnet from the primary condenser tubes through the orifices and flow toward the center of the heat exchanger panel where they enter the top of the secondary condenser section tubes. In this arrangement the second stage of condensing occurs in co-current operation. Non-condensables and condensate flow out the bottom of the secondary tubes into an internal secondary chamber located inside the bottom bonnet. Non-condensables and condensate are drawn from the bottom bonnet secondary chamber via an outlet nozzle, non-condensable gases are separated out and sent to the air-removal system, and condensate is drawn off and sent to join the water collected from the primary condenser sections. The fraction of primary condenser tubes is as much as or greater than 90% of the total heat exchanger section of the ACC and the fraction of secondary condenser tubes is as little as or less than 10% of the total heat exchanger section of the ACC.

Figure 1A:
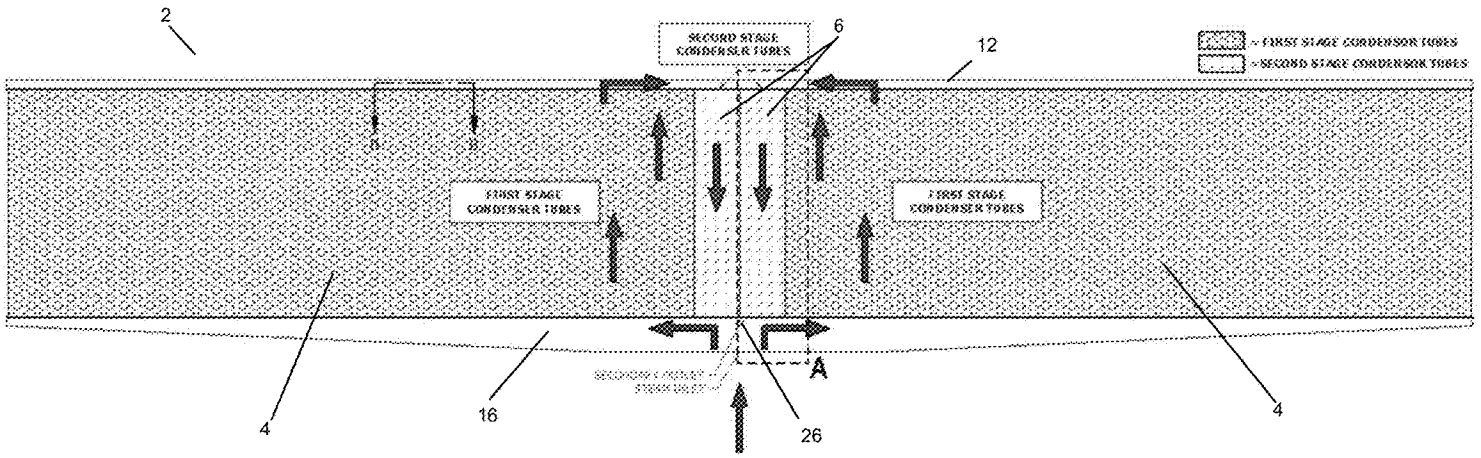
FIG. 1A is side elevation view of a two stage heat exchanger panel according to a preferred embodiment of the invention.
Figure 2:
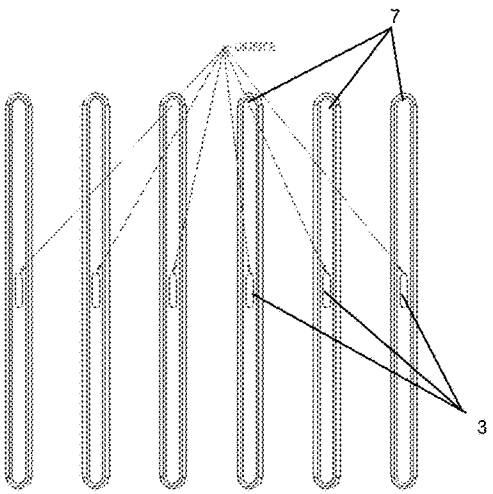
FIG. 2 is a topside down view of primary condenser tubes along Section B-B of FIG. 1A.

Features in the attached drawings are numbered with the following reference numerals:

| | |
|---|---|
| 2 | heat exchanger panel |
| 3 | primary tube outlet orifice |
| 4 | primary condenser section |
| 5 | primary tube outlet cap/plate |
| 6 | secondary condenser section |
| 7 | tubes |
| 8 | condenser bundles |
| 10 | top tube sheet |
| 12 | top bonnet |
| 14 | bottom tube sheet |
| 15 | lifting/support angle |
| 16 | bottom bonnet |
| 18 | stem inlet/condensate outlet |
| 20 | shield plate |
| 21 | perforations |
| 22 | scalloped edge |
| 24 | secondary bottom bonnet |
| 26 | nozzle (for secondary bottom bonnet) |
| 27 | ACC condenser module (cell) |
| 29 | Y-shaped nozzle |
| 31 | turbine exhaust duct (generic) |
| 34 | street/row of ACC cells |
| 36 | frame (of heat exchange section) |
| 37 | heat exchange module |
| 40 | deflector shield |
| 42 | condensate piping |
| 50 | hangers |
| 62 | understructure module |
| 64 | plenum section module |
| 66 | steam distribution manifold (SDM) |
| 68 | elevated turbine exhaust duct |
| 72 | fan deck plate |
| 74 | small fan |
| 76 | ground level turbine exhaust duct (GLTED) |
| 78 | end riser (GLTED to SDM) |

DETAILED DESCRIPTION

Figure 1B:
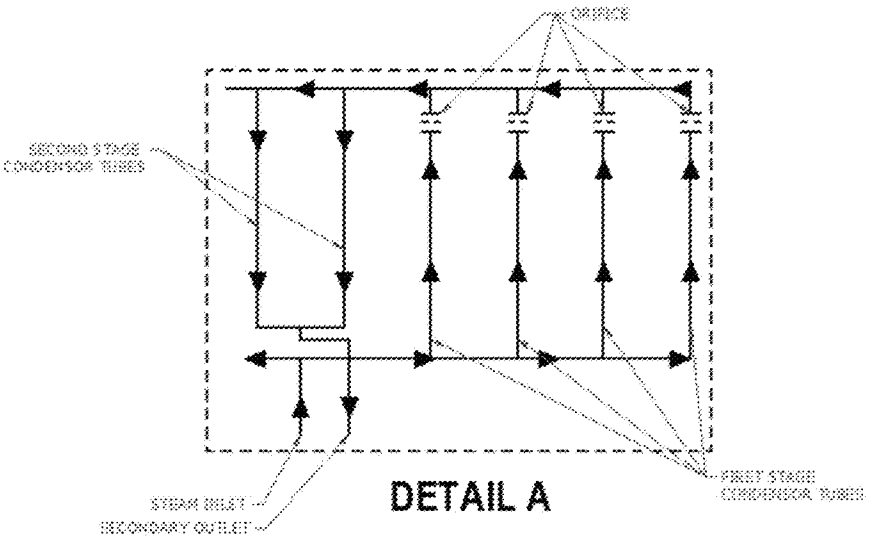
FIG. 1B is representation of flow patterns in Detail A of FIG. 1A.
Figure 3:
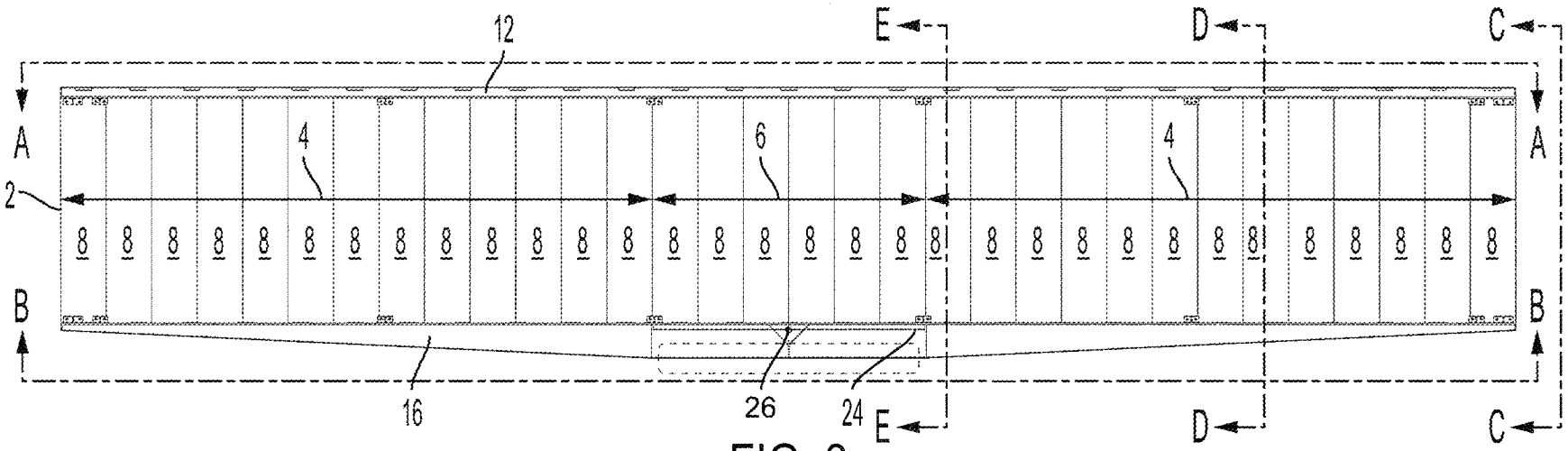
FIG. 3 is a side view of a two stage heat exchanger panel according to an embodiment of the invention.
Figure 4:
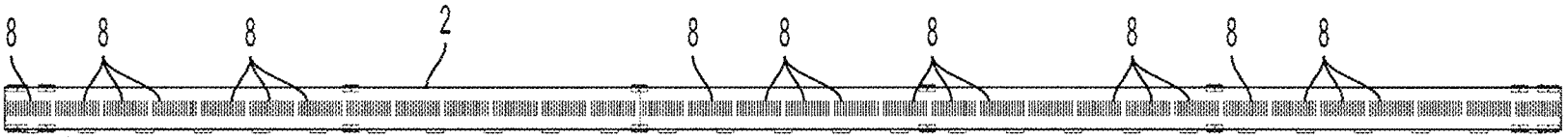
FIG. 4 is a top view of the heat exchanger panel shown in FIG. 3.
Figure 5:
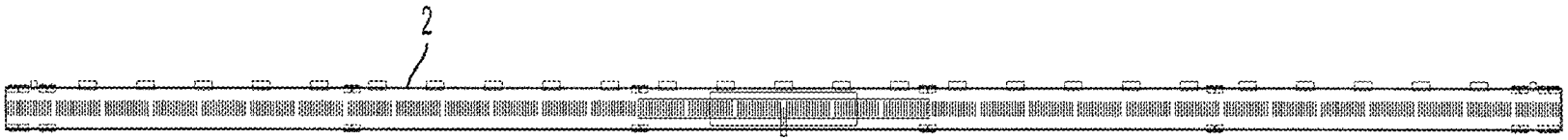
FIG. 5 is a bottom view of the heat exchanger panel shown in FIG. 3.
Figure 8:
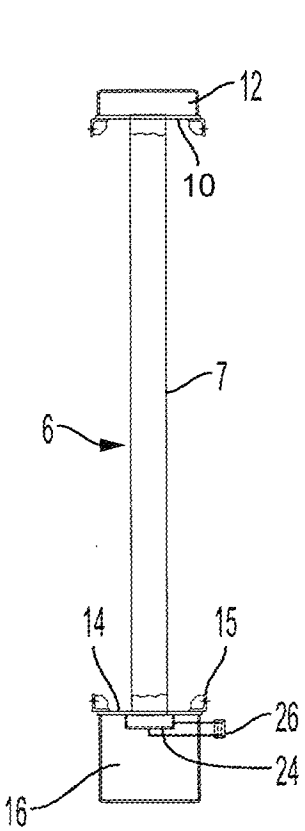
FIG. 8 is a cross-sectional view of the heat exchanger panel shown in FIG. 3, along line E-E.
Figure 7:
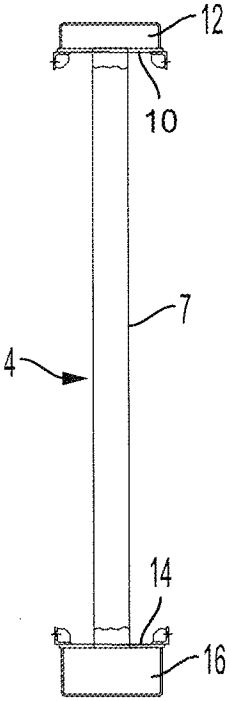
FIG. 7 is a cross-sectional view of the heat exchanger panel shown in FIG. 3, along line D-D.
Figure 6:
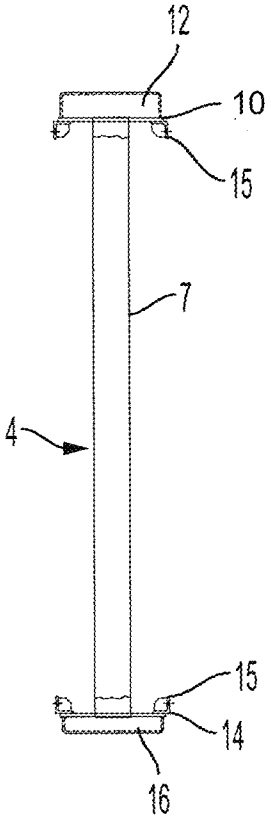
FIG. 6 is a cross-sectional view of the heat exchanger panel shown in FIG. 3, along line C-C.
Figure 9:
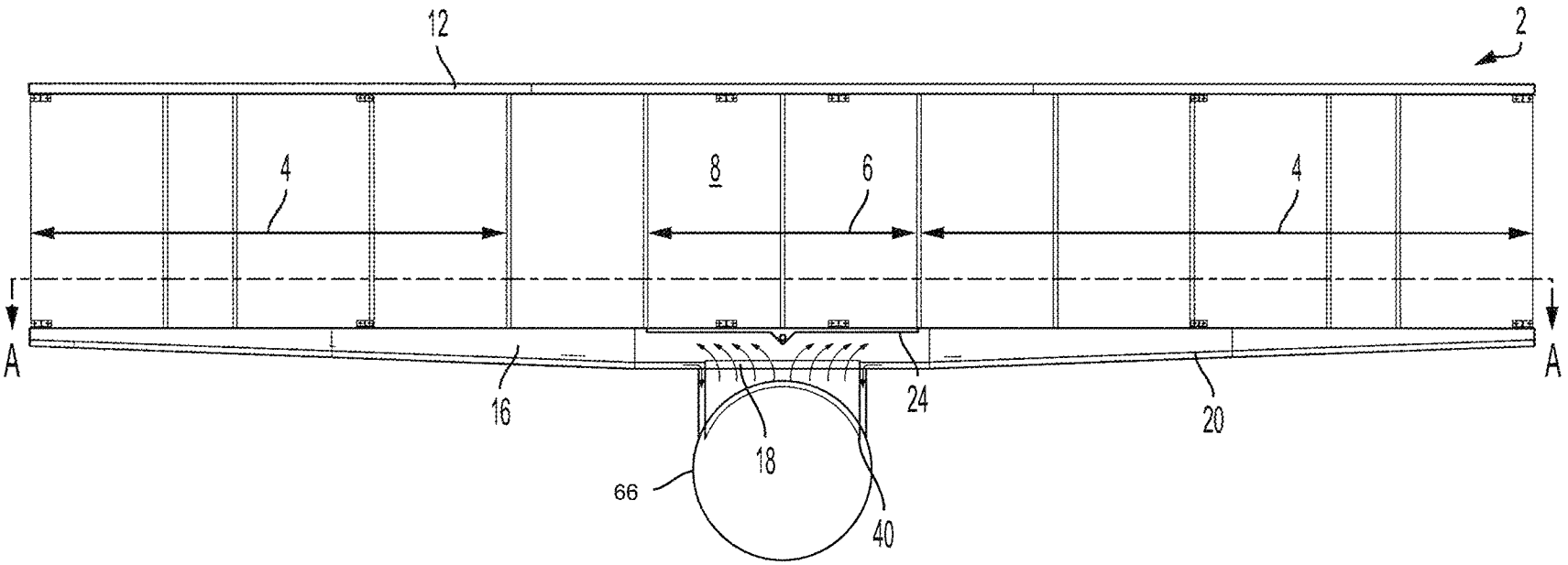
FIG. 9 is a side elevation view of a two stage heat exchanger panel and upper steam distribution manifold according to an alternate embodiment of the invention.
Figure 10A:
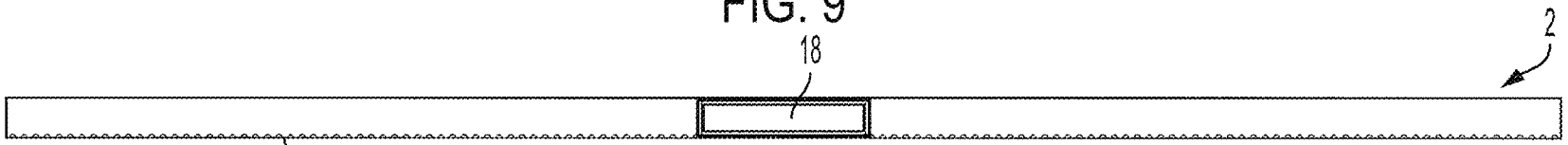
FIG. 10A is a Section view along line A-A of FIG. 9.
Figure 10B:
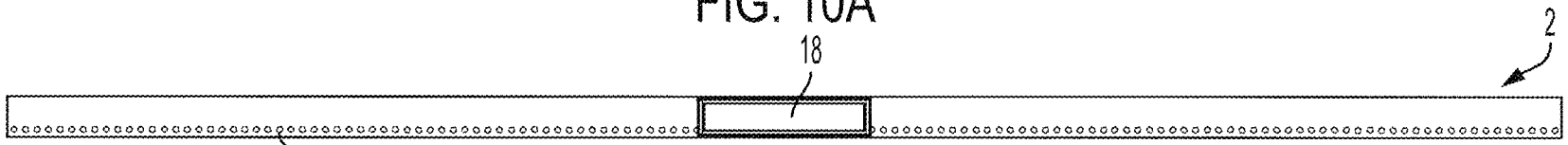
FIG. 10B is alternative embodiment to the embodiment shown in FIG. 10A.

As outlined in the Summary of the Invention, a central innovation of the present invention is a primary condenser tube for an ACC having primary tube outlet cap/plate 5 with an outlet orifice 3 as shown in FIG. 1B. The orifices can have any shape, including round, rectangular, oval and elliptical. Each tube may have an outlet cap/plate with only a single orifice, or each tube's outlet cap/plate may have more than one orifice. The total area of all outlet orifices 3 for one tube is preferably 50% or less of the cross-sectional area of the tube. According to preferred embodiments, the total area of the one or more outlet orifices for a single tube is 5% to 50% of the cross-sectional area of tube. According to more preferred embodiments, the total area of the one or more outlet orifices for a single tube is 10% to 40% of the cross-sectional area of tube. According to even more preferred embodiments, the total area of the one or more outlet orifices for a single tube is 20%-30% of the cross-sectional area of the tube. The proportion of primary condenser tubes to secondary condenser tubes in a cell/module, in a row or street of cells/modules, or across the entire ACC is preferably 90:10, but may range from 85:15 to 95:5. As noted above, the size of the primary tube outlet orifices 3 and the proportion of secondary tubes may be selected to reduce outlet manifold pressure to a desired target in order to regulate and balance the vapor flow across the primary condenser tubes, thereby reducing or eliminating the risk of backflow and the formation of dead zones at the top of the primary condenser tubes.

Figure 12:
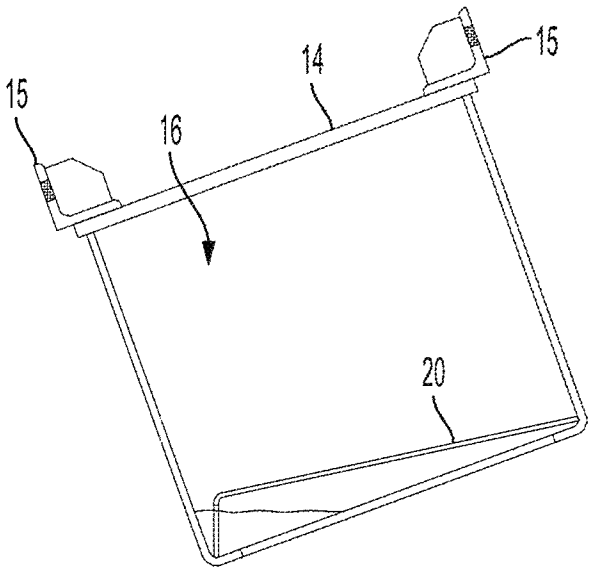
FIG. 12 is a cross-sectional view of a bottom bonnet of the type shown in FIG. 9 with a bended shield plate according to an embodiment of the invention.
Figure 11:
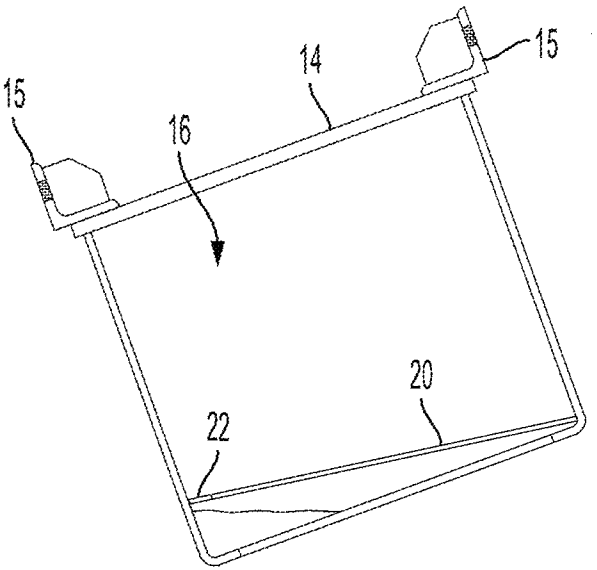
FIG. 11 is a cross-sectional view of a bottom bonnet of the type shown in FIG. 9 with a flat shield plate according to an embodiment of the invention.
Figure 13:
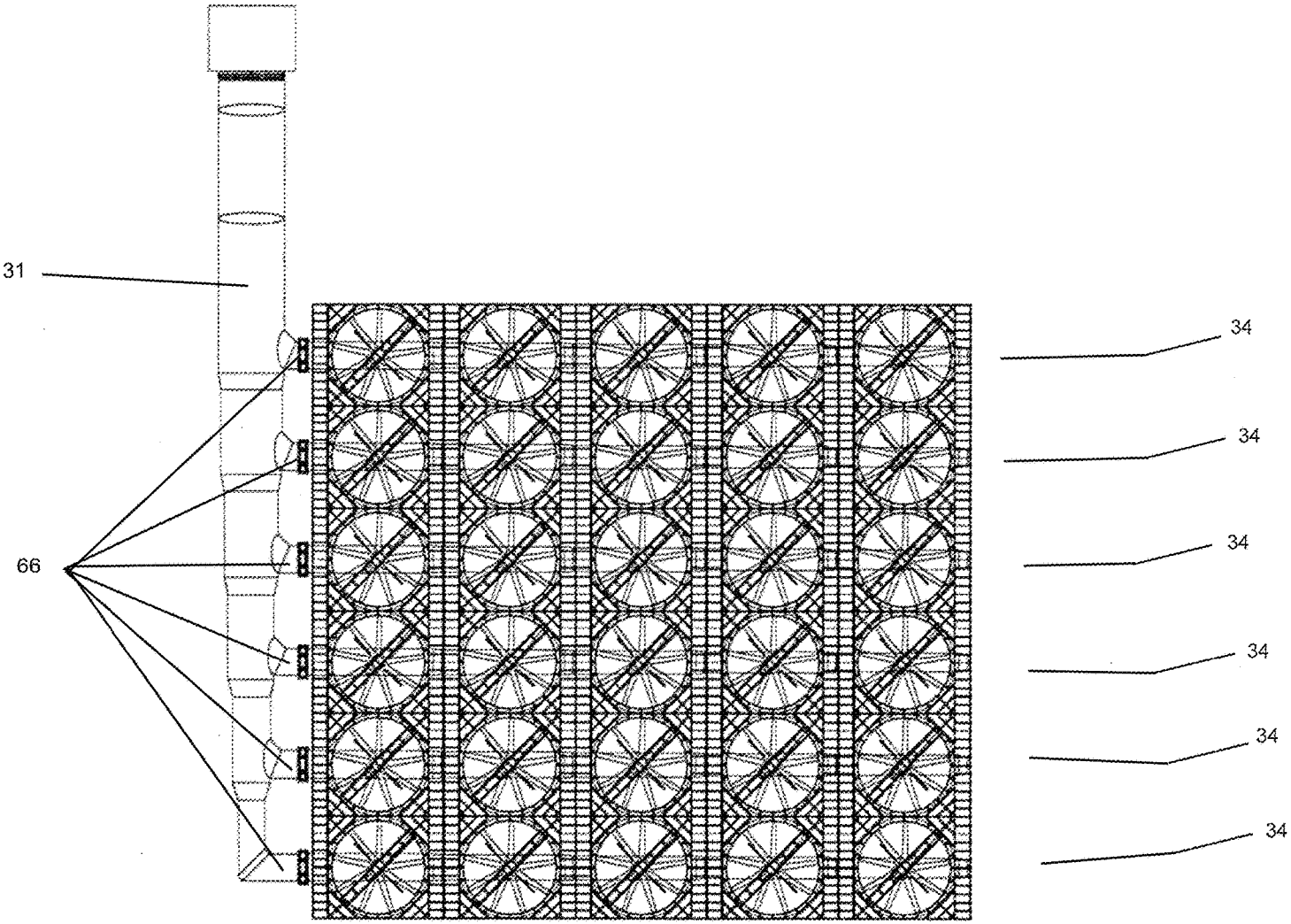
FIG. 13 is a plan view of a large scale field erected air cooled industrial steam condenser according to an embodiment of the invention.

The features of the invention may be used in conjunction with ACCs of any configuration, but are most preferably in conjunction with an ACC according to the various configurations shown in FIGS. 3-30. Referring to FIGS. 3-8, the heat exchanger panel 2 includes two primary condenser sections 4 flanking an integrated and centrally located secondary condenser section 6. Each heat exchanger panel 2 consists of a plurality of separate condenser bundles 8, with a first subset of condenser bundles 8 making up the centrally located secondary section 6, and a second subset of different condenser bundles 8 making up each flanking primary section 4. The dimensions and constructions of the tubes 7 of the primary and secondary sections are preferably identical with the exception of the outlet orifices at the top of the tubes in the primary section. At their top, all of the tubes 7 of both the primary and secondary sections 4, 6 are joined to a top tube sheet 10, on which sits a hollow top bonnet 12 which runs the length of the top of the heat exchanger panel 2. The bottom of all of the tubes 7 of the primary and secondary sections 4, 6 are connected to a bottom tube sheet 14, which forms the top of a bottom bonnet 16. The bottom bonnet 16 likewise runs the length of the heat exchanger panel 2. The bottom bonnet 16 is in direct fluid communication with the tubes 7 of the primary section 4 but not with the tubes of the secondary section 6. The bottom bonnet 16 is fitted at the center point of its length with a single steam inlet/condensate outlet 18 which receives all the steam for the heat exchanger panel 2 and which serves as the outlet for condensate collected from the primary sections 4. The bottom of the bottom bonnet 16 is preferably angled downward at an angle of between 1° and 5°, preferably about 3° with respect to the horizontal from both ends of the bonnet 16 toward the steam inlet/condensate outlet 18 at the middle of the heat exchanger panel 2. According to a preferred embodiment and referring to FIGS. 9-12, the bottom bonnet 16 may include a shield plate 20 to partition condensate flow from the steam flow. The shield 20 may have perforations 21 and/or have a scalloped edge 22 or have other openings or configuration to allow condensate falling on top of the shield 20 to enter the space beneath the shield and to flow beneath the shield toward the inlet/outlet 18. When viewed from the end of the bottom bonnet 16, the shield plate 20 is secured at a near-horizontal angle (between horizontal and 12° from horizontal in the crosswise direction) so as to maximize the cross-section provided by the bottom bonnet 16 to the flow of steam. The shield plate 20 may be flat as shown in FIG. 11 or bended as shown in FIG. 12. The top tube sheet 10 and bottom tube sheet 14 may be fitted with lifting/support angles 15 for lifting and/or supporting the heat exchangers 2.

An internal secondary chamber, or secondary bottom bonnet 24, is fitted inside the bottom bonnet 16 in direct fluid connection with only the tubes 7 of the secondary section 6 and extends the length of the secondary section 6, but preferably not beyond. This secondary bottom bonnet 24 is fitted with a nozzle 26 to withdraw non-condensables and condensate.

Figure 23:
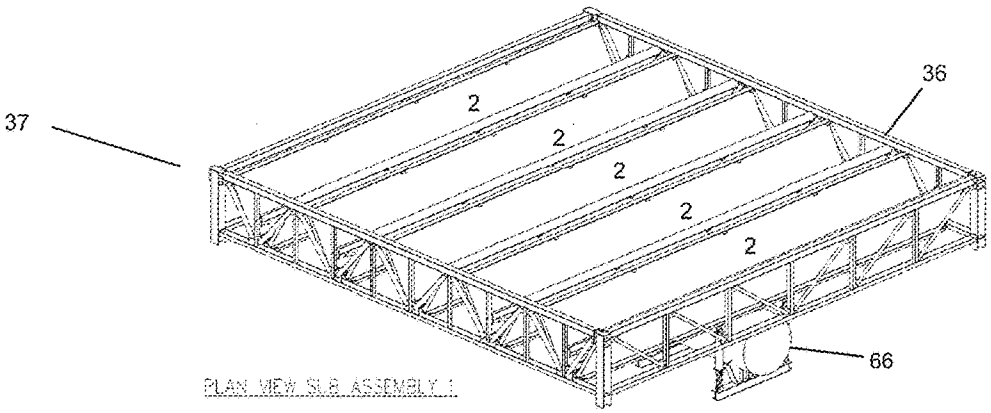
FIG. 23 shows a top perspective view of a single pre-assembled condenser module including the upper steam distribution manifold suspended therefrom.
Figure 24:
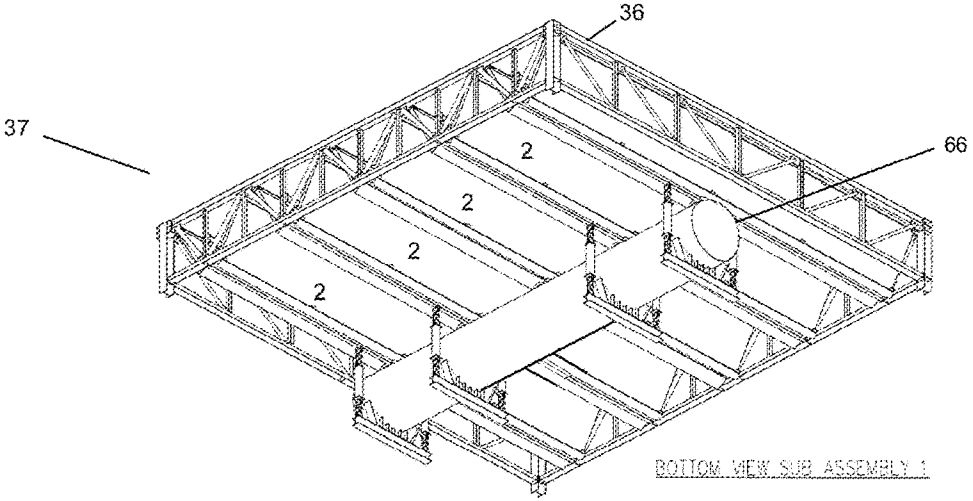
FIG. 24 shows a bottom perspective view of a single pre-assembled condenser module including a steam distribution manifold suspended therefrom.
Figure 25:
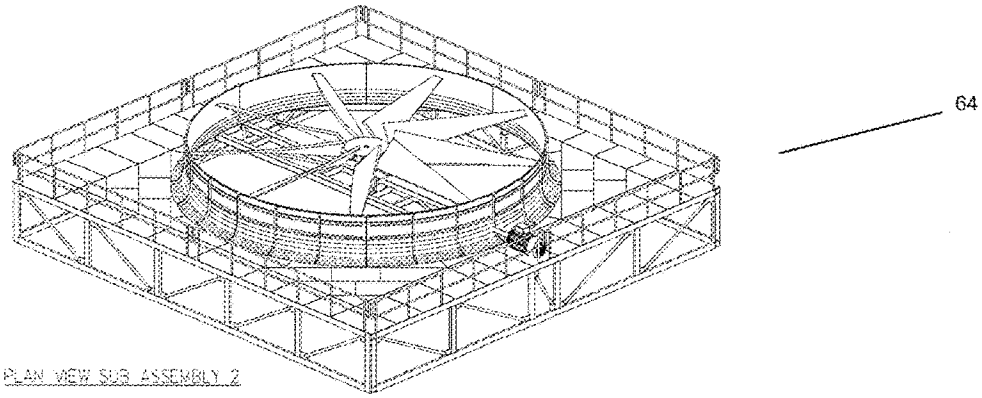
FIG. 25 shows a top perspective view of a fan deck and fan (plenum) subassembly for a single cell corresponding to the condenser module shown in FIGS. 23 and 24.
Figure 26:
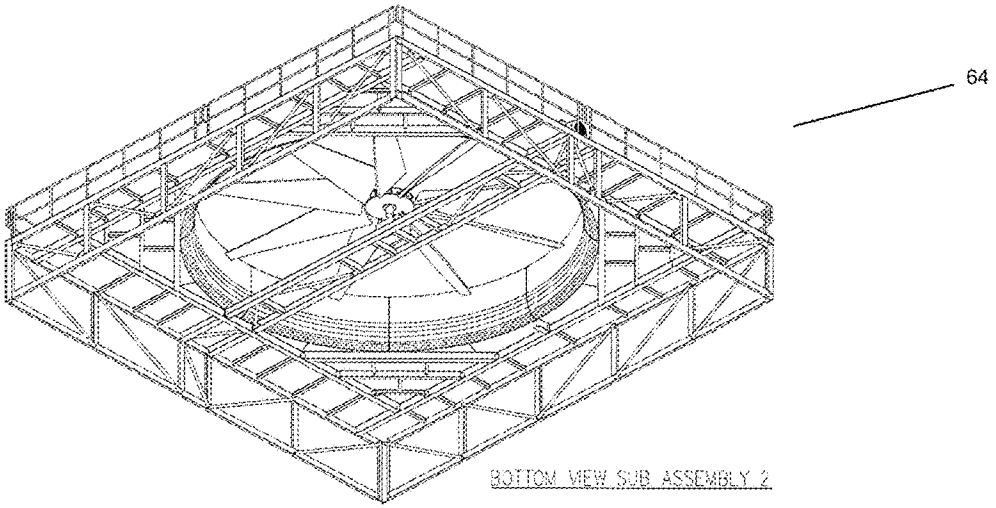
FIG. 26 shows a bottom perspective view of a fan deck and fan (plenum) subassembly for a single cell corresponding to the condenser module shown in FIGS. 23 and 24.
Figure 27:
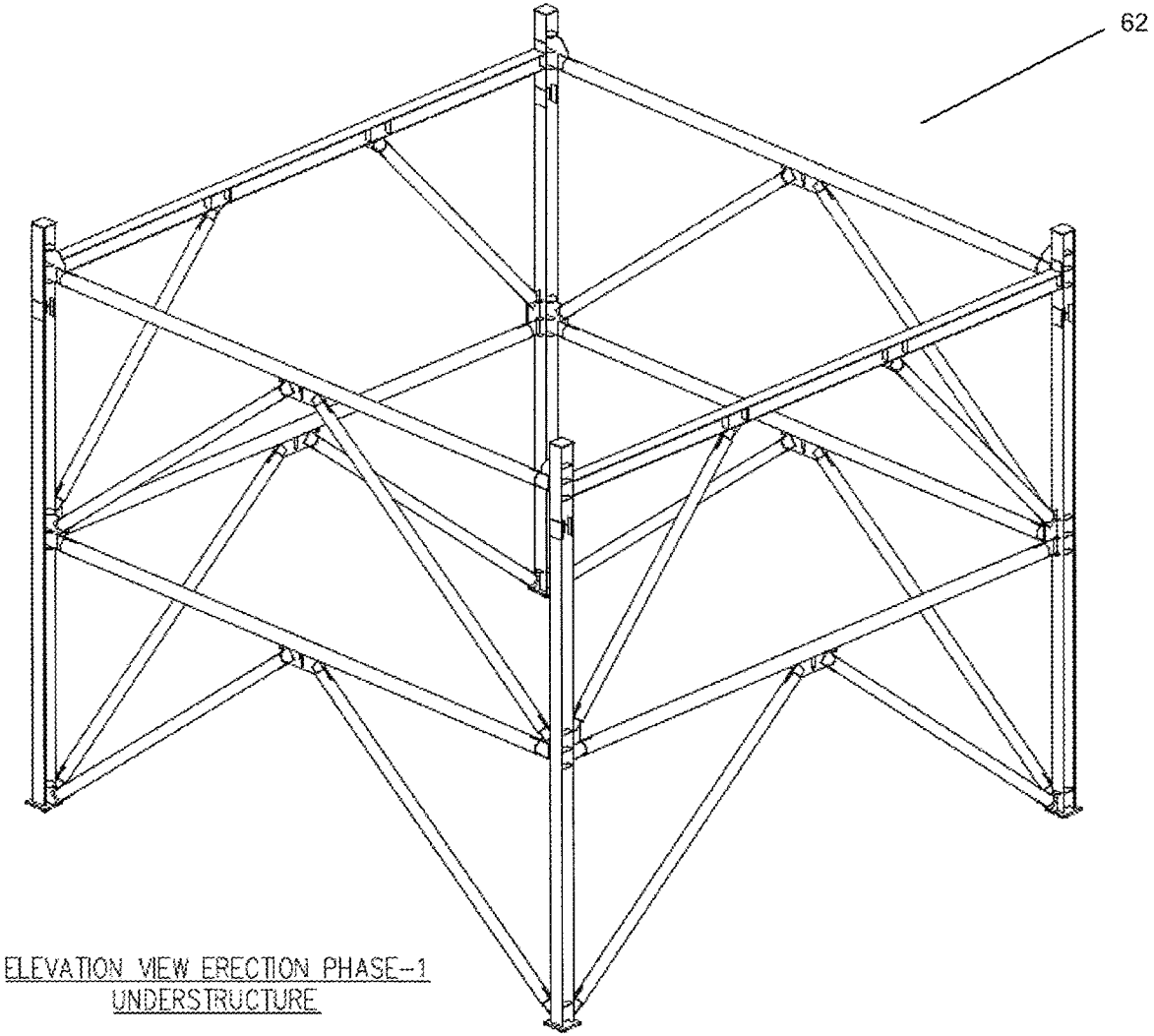
FIG. 27 shows a perspective view of a tower frame for a single cell corresponding to the condenser module shown in FIGS. 23 and 24.
Figure 28:
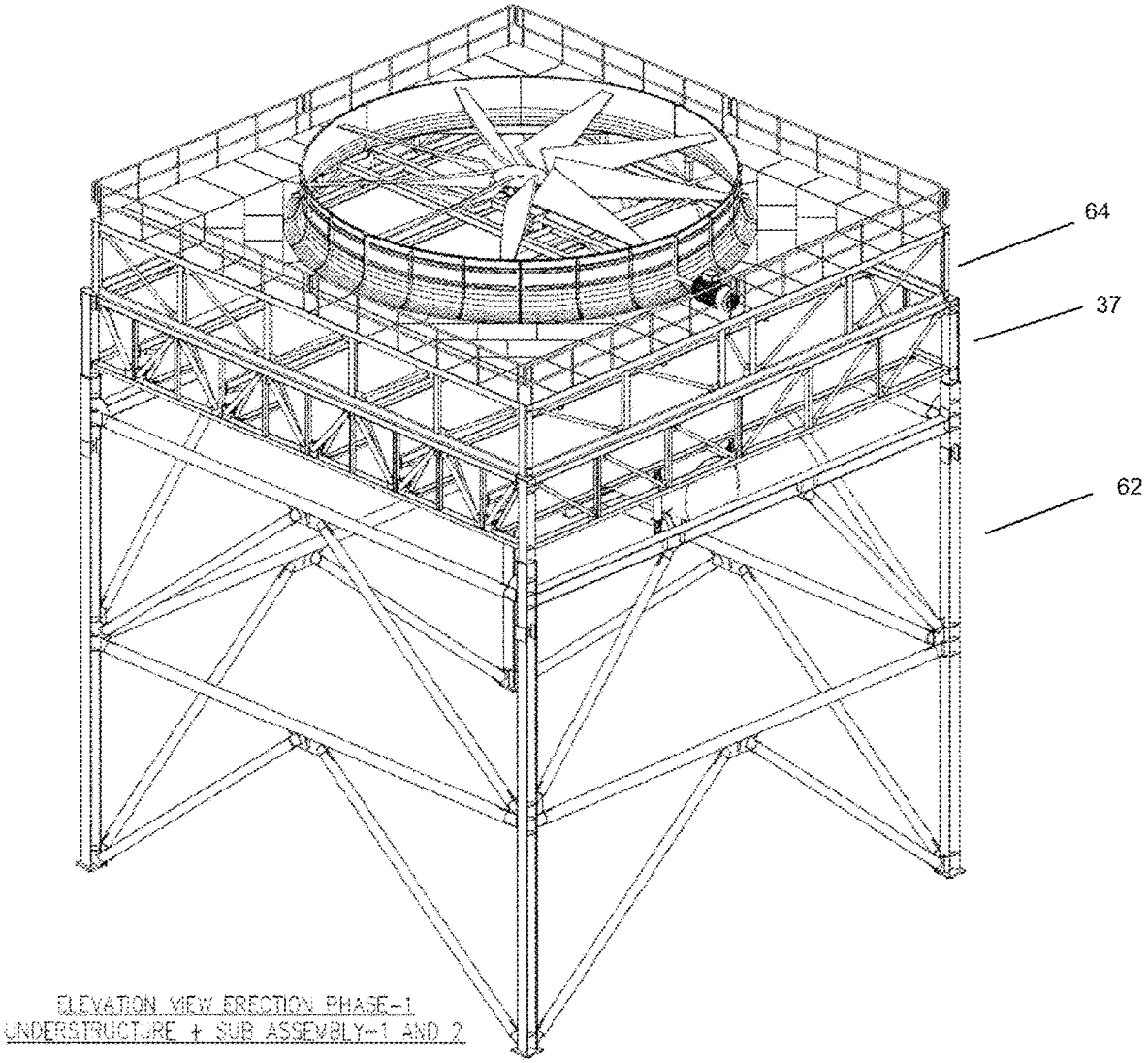
FIG. 28 shows a fully assembled ACC cell with the fan deck and fan (plenum) subassembly of FIGS. 25 and 26 installed atop the condenser module of FIGS. 23 and 24 and the tower section of FIG. 27.
Figure 30:
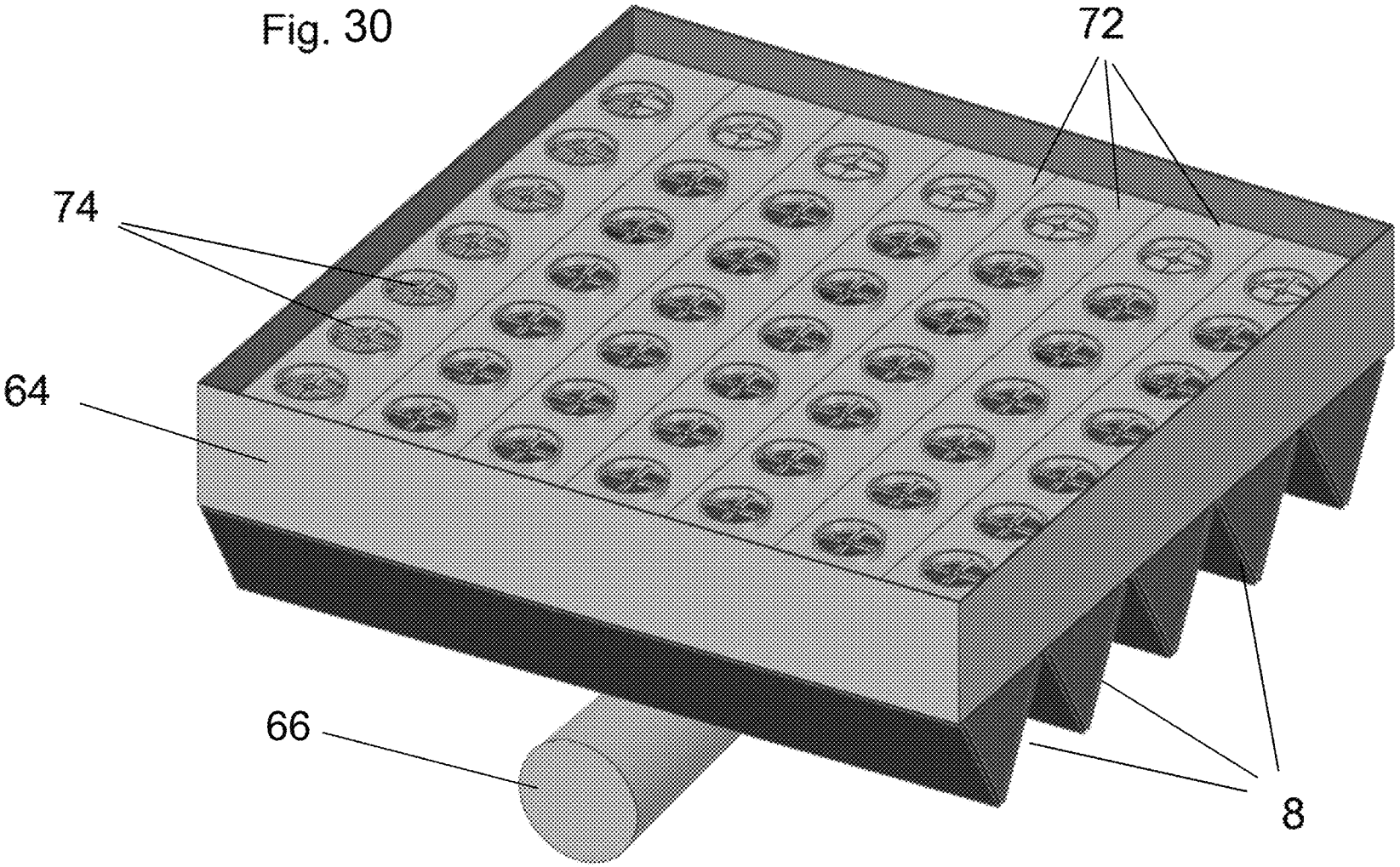
FIG. 30 is a representation of an embodiment of the invention in which the fan deck includes a plurality of fan deck plates supported on the fan deck structure above the heat exchange module, where each fan deck plate includes a plurality of fans, and the fan deck plates are arranged so that their longitudinal axis is perpendicular to the longitudinal axis of the heat exchange panels.

The steam inlet/condensate outlet 18 for the heat exchanger panel 2 and the steam inlet/condensate outlets 18 for all of the heat exchanger panels in the same ACC cell/module 27 are connected to a steam distribution manifold 66 located beneath the heat exchanger panels 2 and which runs perpendicular to the longitudinal axis of the heat exchanger panels 2 at their midpoint See, e.g., FIGS. 23, 24 and 30. In this embodiment, the steam distribution manifold 66 extends across the width of the cell/module 27 and continues to adjacent cell/modules. Where the top surface of the steam distribution manifold (SDM) 66 passes below the center point of each heat exchanger panel 2, the steam distribution manifold 66 is fitted with a Y-shaped nozzle 29 which connects to the steam inlet/condensate outlets 18 at the bottom of each adjacent pair of heat exchanger panels 2 (See, e.g., FIG. 16).

According to this construction, each cell 27 of the ACC receives steam from a steam distribution manifold 66 located directly beneath the center point of each heat exchanger panel 2, and the steam distribution manifold 66 feeds steam to each of the heat exchanger panels 2 in a cell 27 via a single steam inlet/condensate outlet 18.

Therefore, the steam from an industrial process travels along the turbine exhaust duct 31 at or near ground level, or at any elevation(s) suited to the site layout. When the steam duct 31 approaches the ACC of the invention, it splits into a plurality of sub-ducts (steam distribution manifolds 66), one for each street (row of cells) 34 of the ACC (See, e.g., FIG. 13). Each steam distribution manifold 66 travels beneath its respective street of cells 34. The steam distribution manifold 66 may be suspended from the frame 36 of the condenser module 37, supported in the frame of understructure module 62 or supported from below by separate structure. The steam distribution manifold 66 delivers steam through a plurality of Y-shaped nozzles 29 to the pair of bonnet inlets/outlets 18 of each adjacent pair of heat exchanger panels 2, FIGS. 15 and 16. The steam travels along the bottom bonnet 16 and up through the tubes 7 of the primary sections 4, condensing as air passes across the finned tubes 7 of the primary condenser sections 4. The condensed water travels down the same tubes 7 of the primary section 4 counter-current to the steam, collects in the bottom bonnet 16 and eventually drains back through the steam distribution manifold 66 and turbine exhaust duct 31 to a condensate collection tank (see, e.g., FIG. 21). According to a preferred embodiment, the connection between the bottom bonnet 16 and the steam distribution manifold 66 may be fitted with a deflector shield 40 to separate the draining/falling condensate from the incoming steam.

The uncondensed steam and non-condensables are collected in the top bonnet 12 and are drawn to the center of the heat exchanger panel 2 where they travel down the tubes 7 of the secondary section 6 co-current with the condensate formed therein. Non-condensables are drawn into the secondary bottom bonnet 24 located inside the bottom bonnet 16 and out through an outlet nozzle 26. Additional condensed water formed in the secondary section 6 collects in the secondary bottom bonnet 24 and travels through the outlet nozzle 26 as well and then travels through condensate piping 42 to the steam distribution manifold 66 to join the water collected from the primary condenser sections 4.

Figure 16:
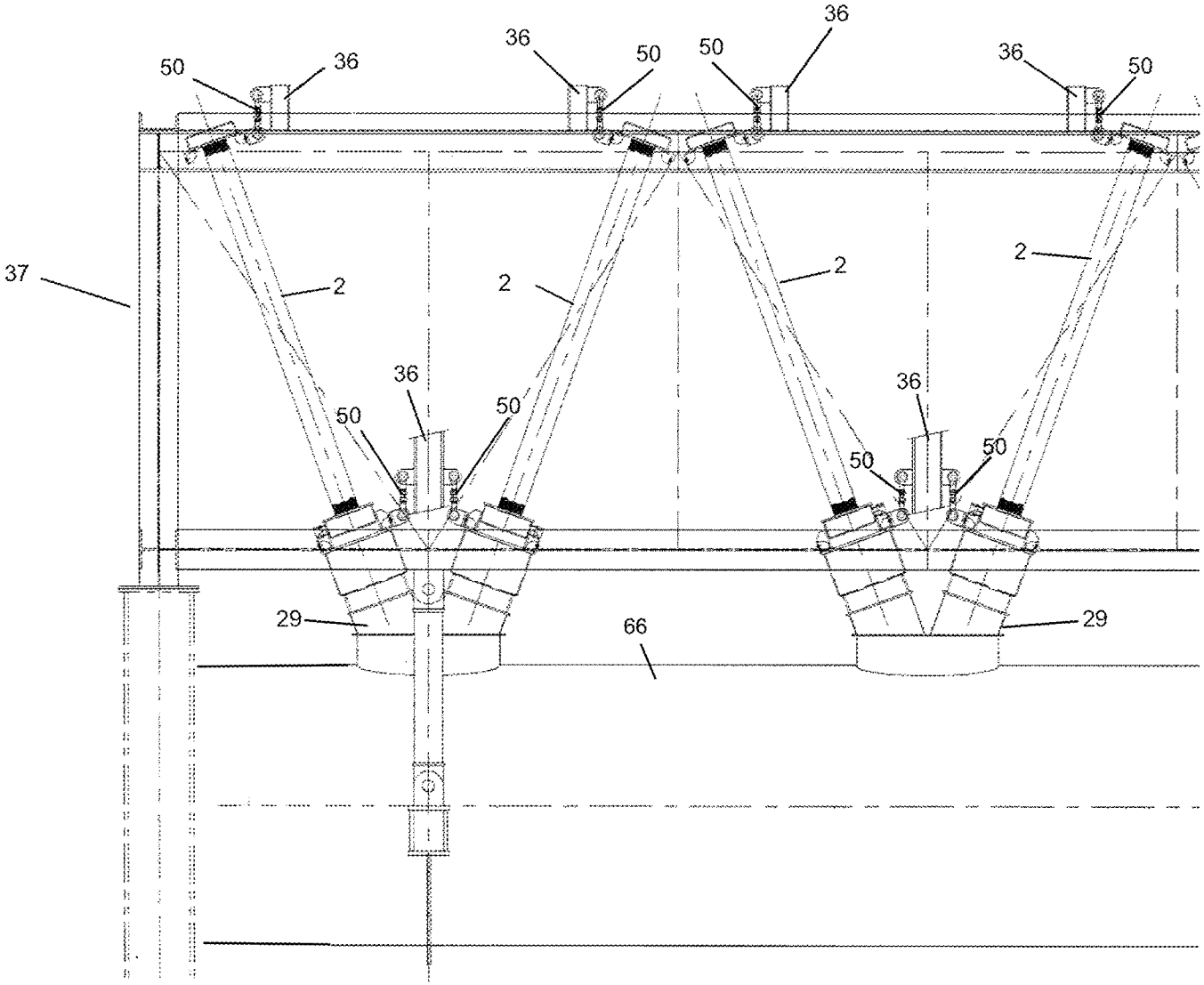
FIG. 16 is a further closeup side view of one cell of the large scale field erected air cooled industrial steam condenser shown in FIG. 14, showing an end view of two pairs of heat exchanger panels.

According to another feature of the invention, the heat exchanger panels 2 are suspended from framework 36 of the condenser module 37 by a plurality of flexible hangers 50 which allow for expansion and contraction of the heat exchanger panels 2 based on heat load and weather. FIG. 16 shows how the hangers 50 are connected to the frame 36 of the condenser module 37

Figure 14:
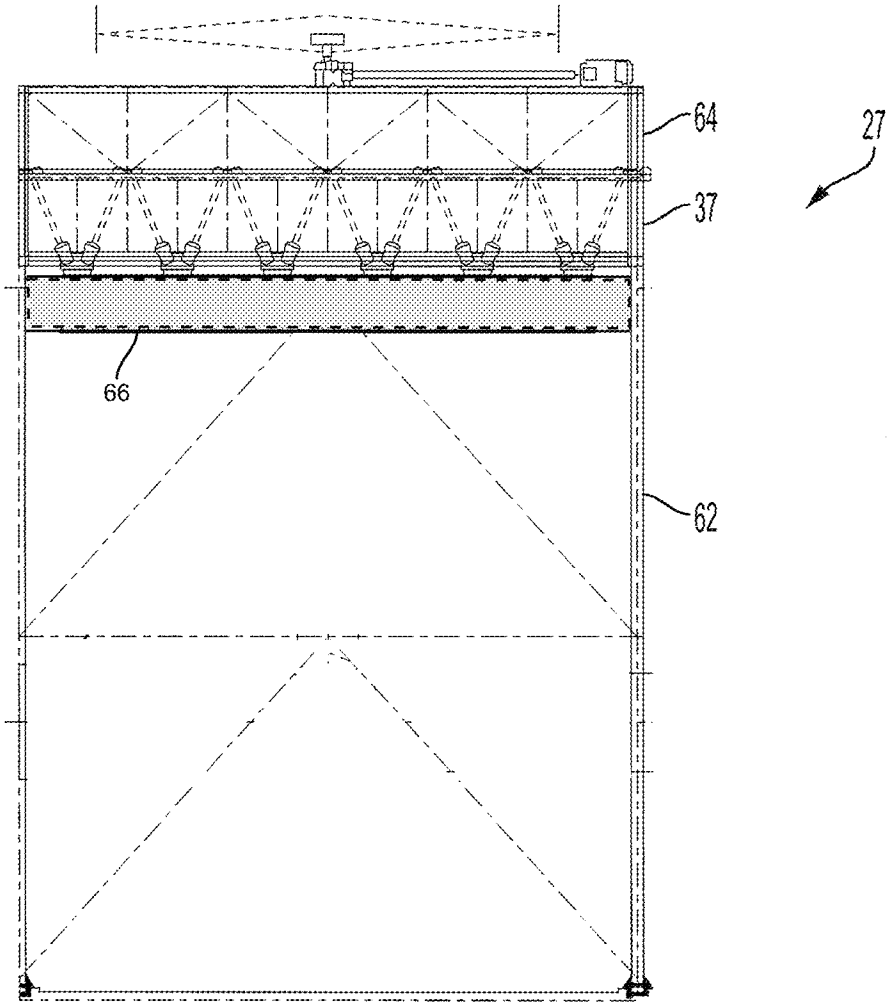
FIG. 14 is a closeup side view of one cell of the large scale field erected air cooled industrial steam condenser shown in FIG. 13.
Figure 15:
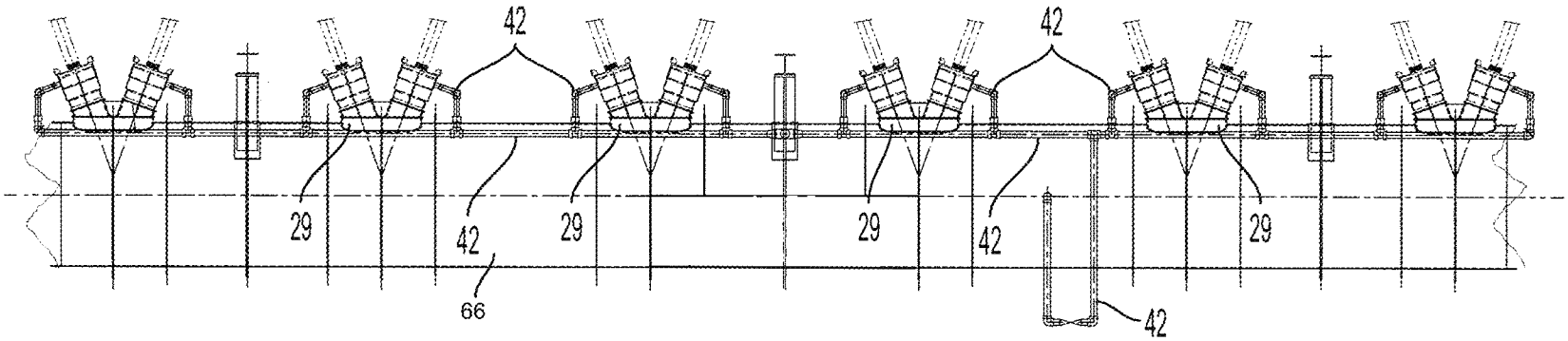
FIG. 15 is an elevation view of the steam distribution manifold and its connections to the heat exchanger panels, including optional condensate piping from the secondary bottom bonnet according to an embodiment of the invention.

The heat exchange panels 2 may each be independently loaded into and supported in heat exchange module framework 36. The heat exchange panels 2 may be supported in the heat exchange module framework 36 according to any of a variety of configurations. FIGS. 14-16 show the heat exchange panels 2 independently supported in the heat exchange module framework 36 with adjacent heat exchange panels 2 inclined relative to vertical in opposite directions in V-shaped pairs.

Figure 17:
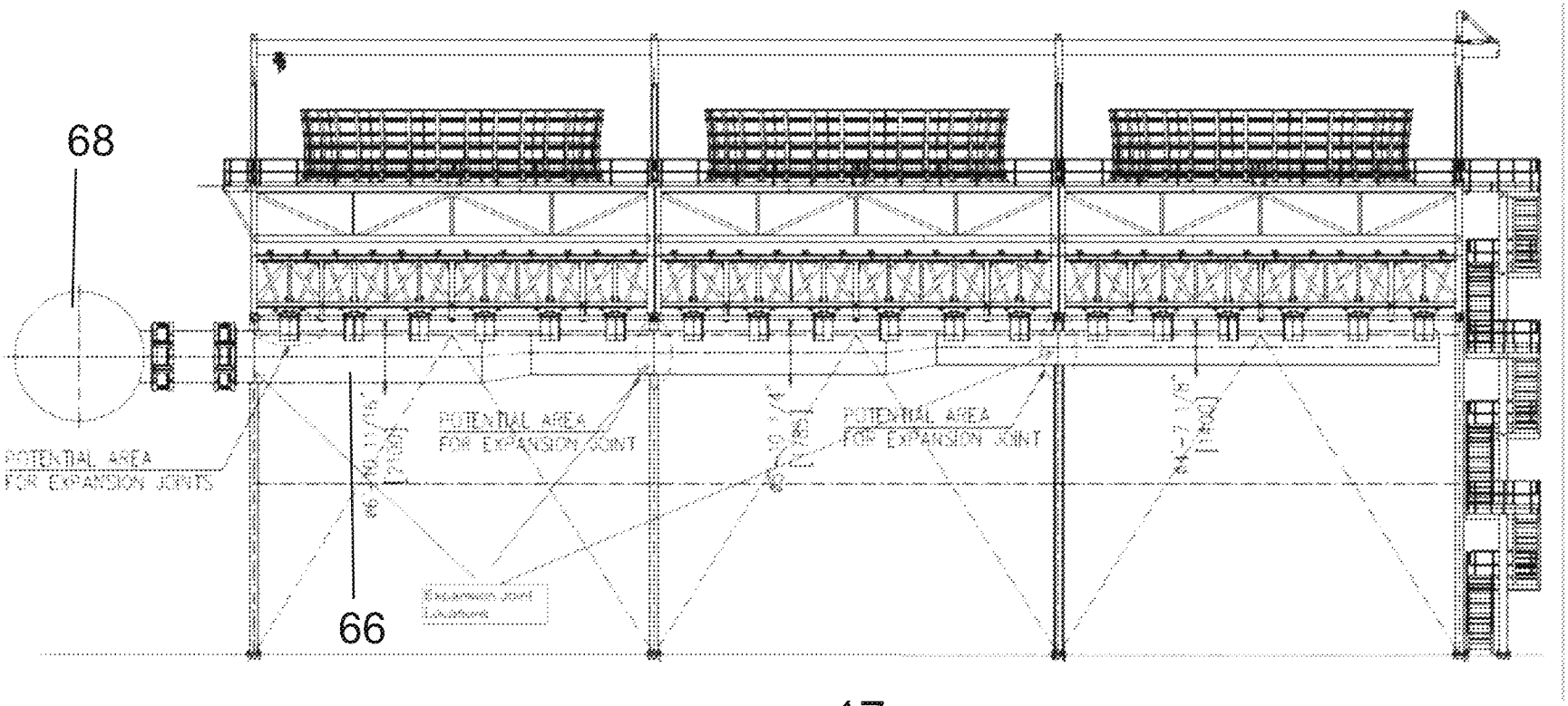
FIG. 17 is side view of a large scale field erected air cooled industrial steam condenser according to an embodiment of the invention in which the steam distribution manifolds are directly connected to an elevated turbine steam duct.
Figure 18:
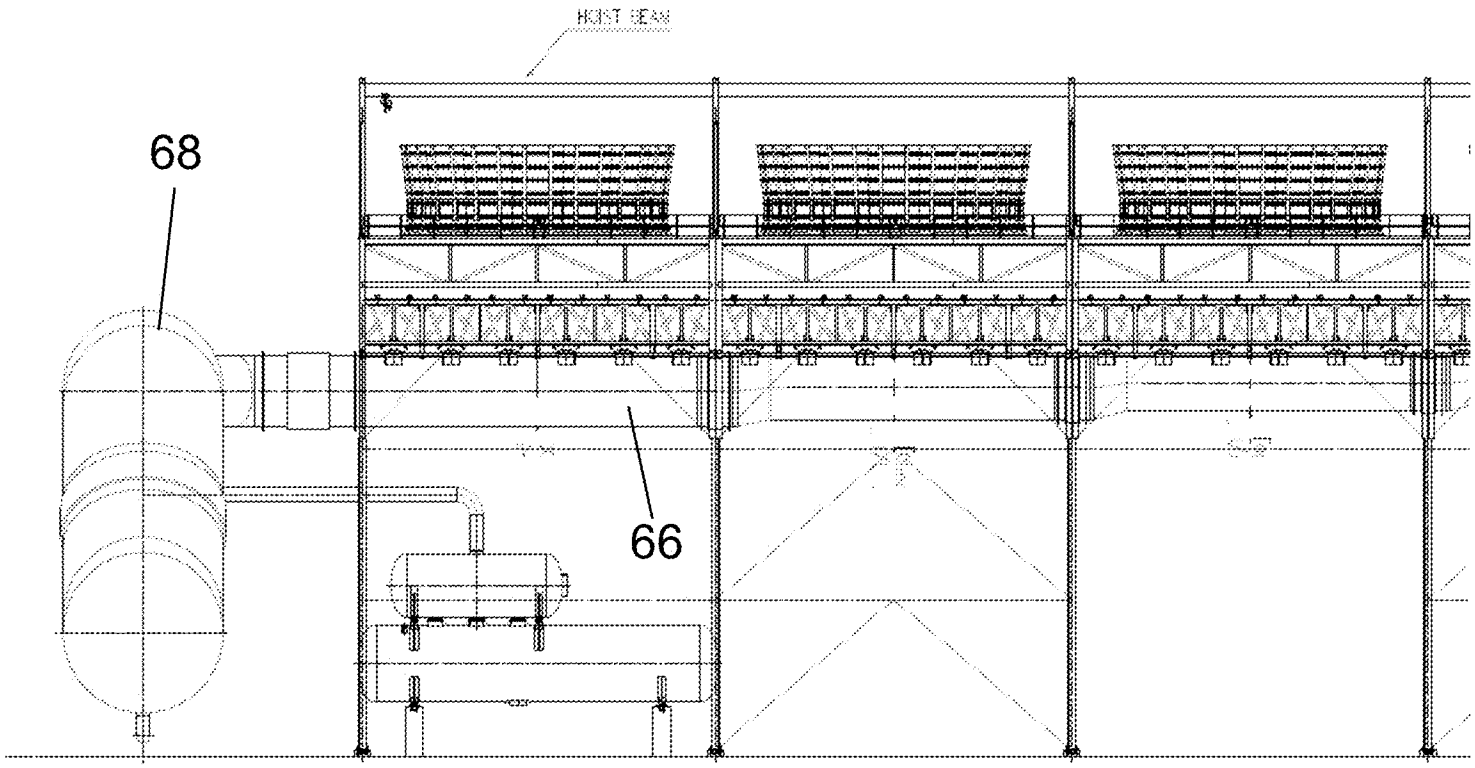
FIG. 18 is side view of a large scale field erected air cooled industrial steam condenser according to an alternate embodiment of the invention in which the steam distribution manifolds are directly connected to an elevated turbine steam duct.
Figure 19:
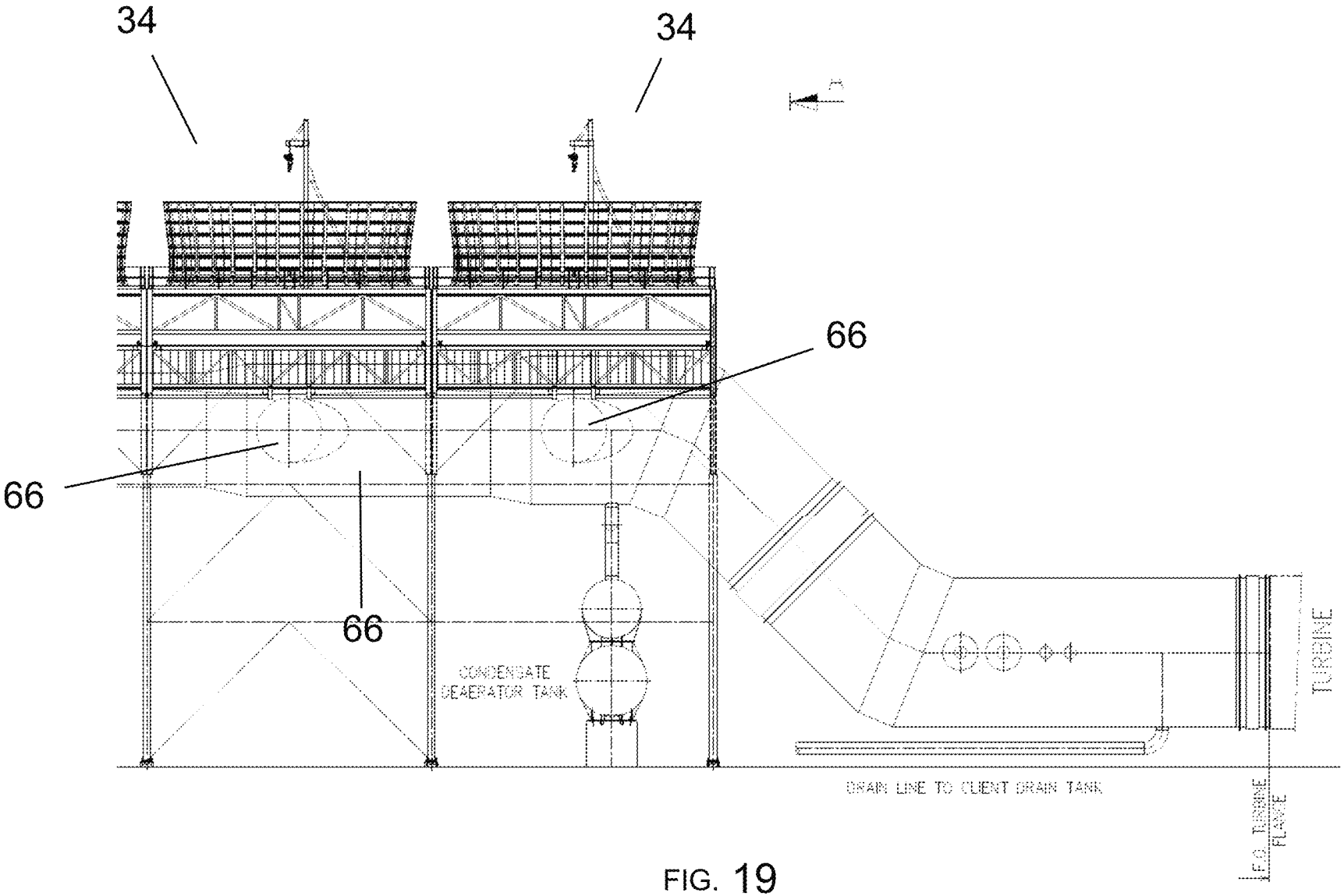
FIG. 19 is an end view of the embodiment shown in FIG. 18.
Figure 20:
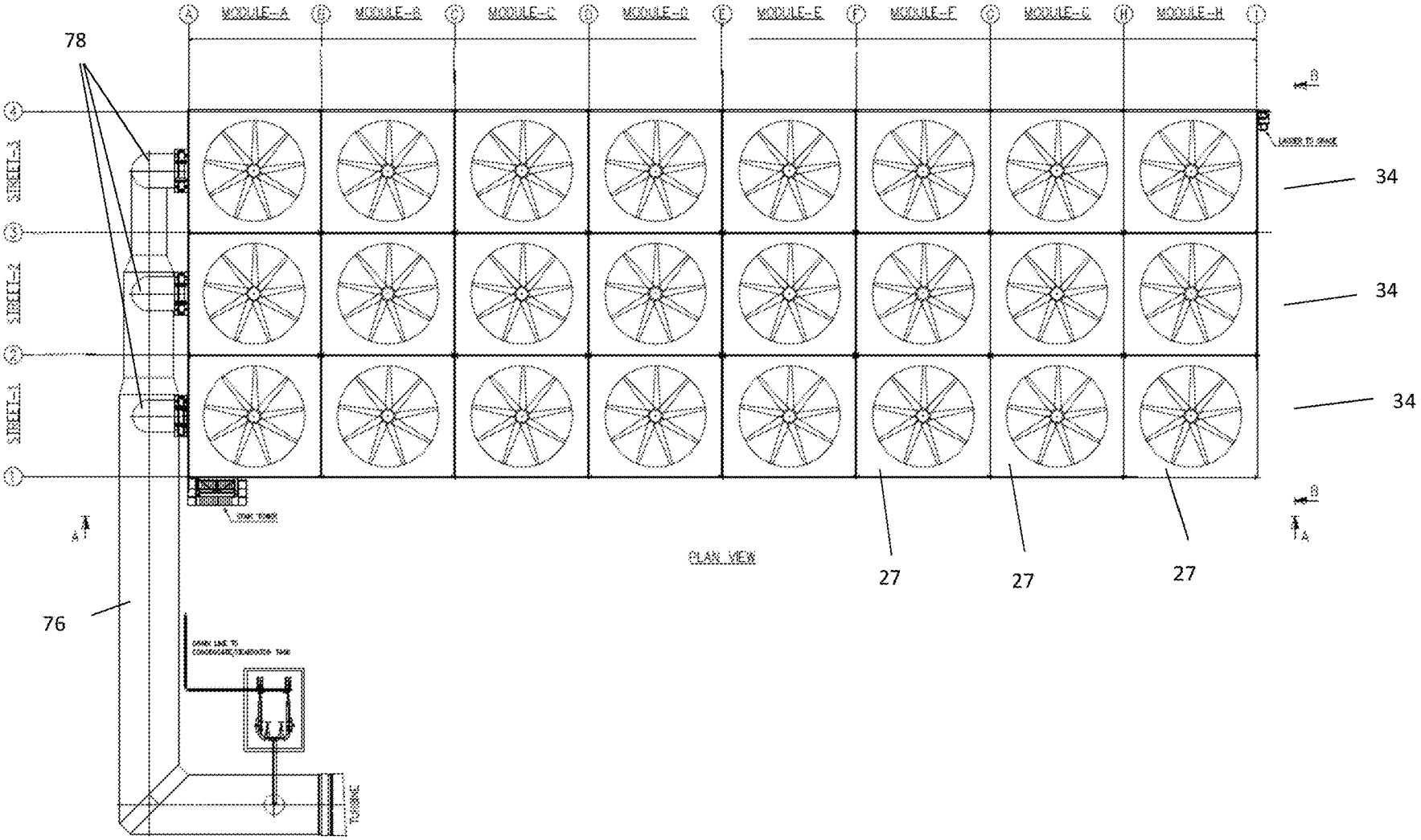
FIG. 20 is a plan view of a large scale field erected air cooled industrial steam condenser according to an embodiment of the invention in which the steam distribution manifolds are connected to a ground level turbine exhaust duct via end risers.
Figure 21:
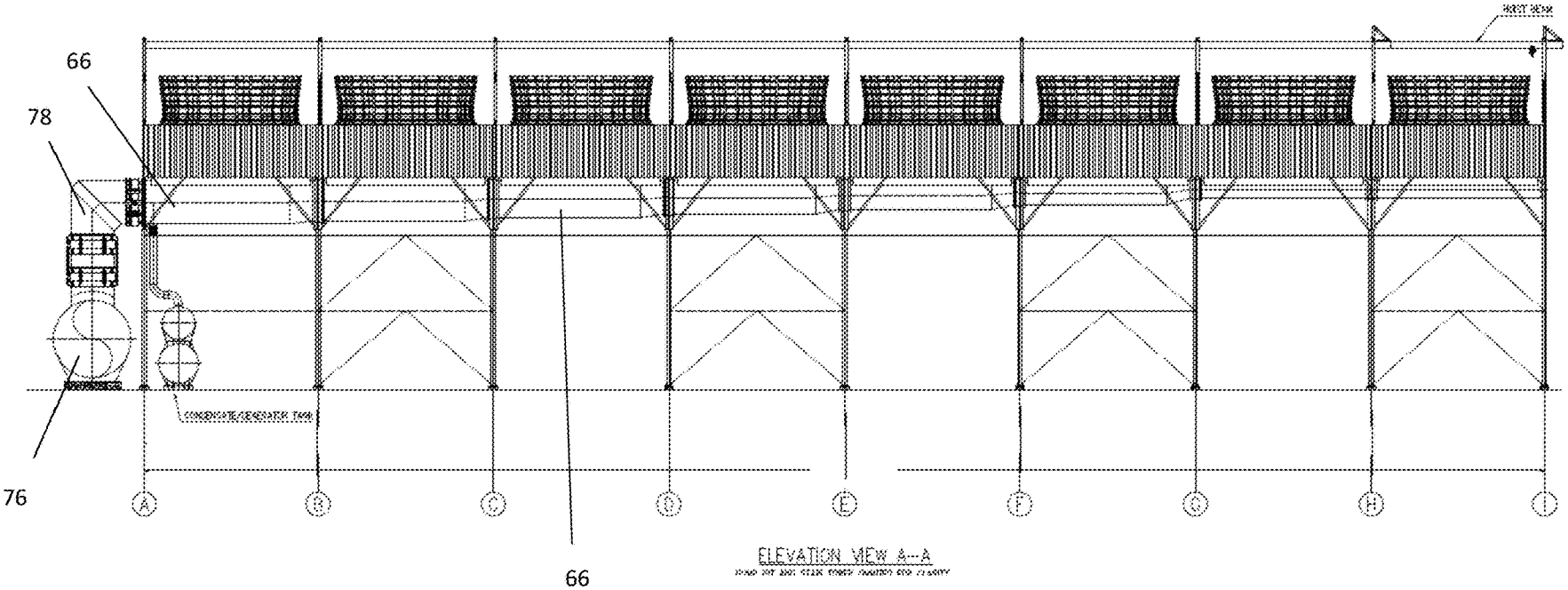
FIG. 21 is an elevation view of the embodiment of FIG. 20, along section A-A.
Figure 22:
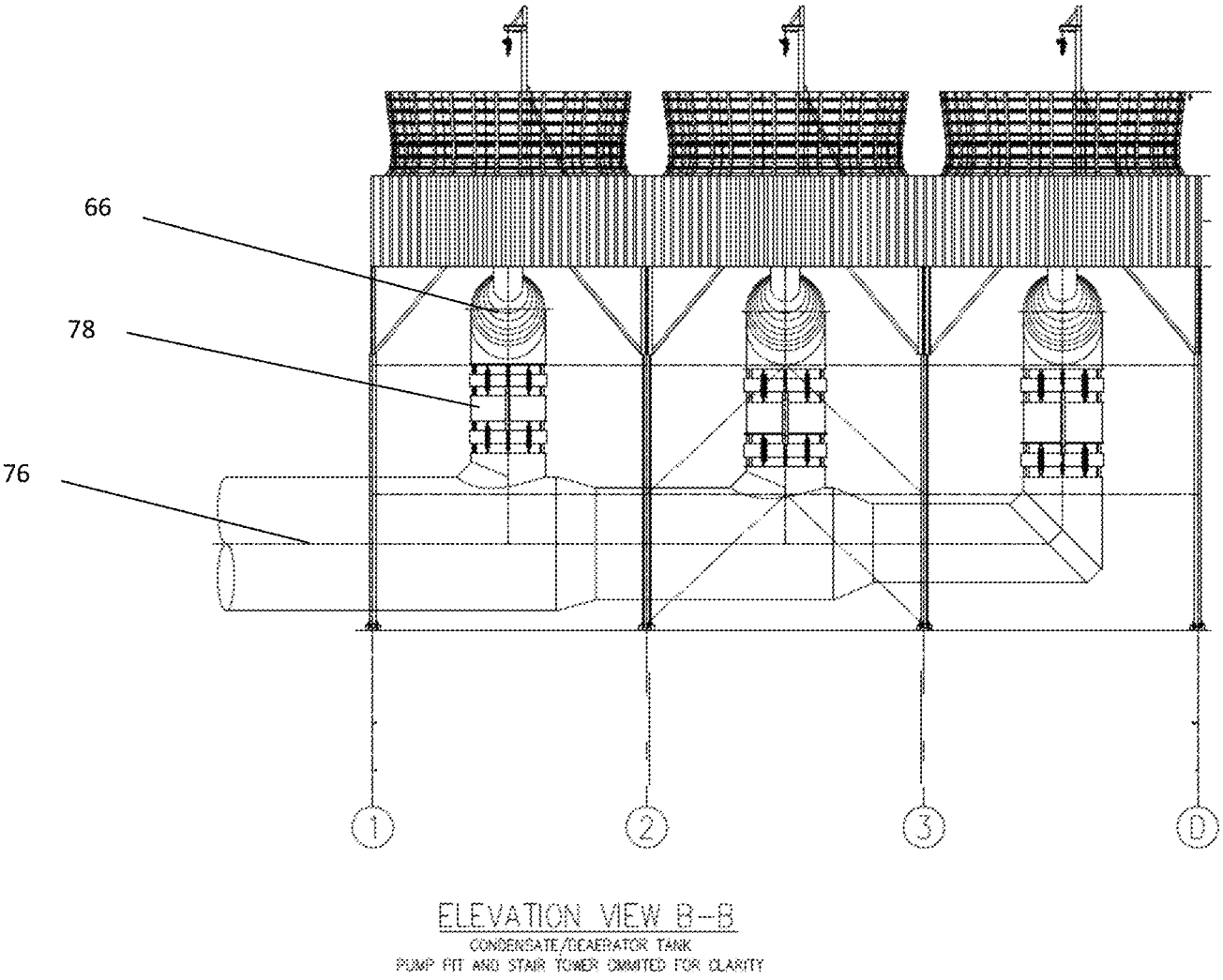
FIG. 22 is an elevation view of the embodiment of FIG. 20, along section B-B.

According to one embodiment of the invention, shown in FIGS. 17-19, the steam distribution manifolds 66 may be connected directly to an elevated turbine steam duct 68 and each steam distribution manifold 66 runs the beneath the center points of the heat exchange panels of a plurality of heat exchange modules along the length of a street/row 34 of condenser cells 27. The steam distribution manifolds 66 may be suspended from the heat exchange module frame as discussed previously or may be supported by other portions of the ACC frame, or may be supported from below by a separate structure.

According to a further alternate embodiment of the invention, shown in FIGS. 20-27, the plurality of steam distribution manifolds (SDM) 66 may be connected to a ground level turbine exhaust duct (GLTED) 76 via end risers 78.

According to preferred embodiments of the invention, the ACCs of the invention are constructed in a modular fashion. According to various embodiments, understructure 62, condenser modules 37 and plenum sections 64 may be assembled separately and simultaneously on the ground. Once the condenser module 37 is assembled it may be lifted and placed on top of the corresponding completed understructure 62 (See, e.g., FIGS. 23-28).

Figure 29:
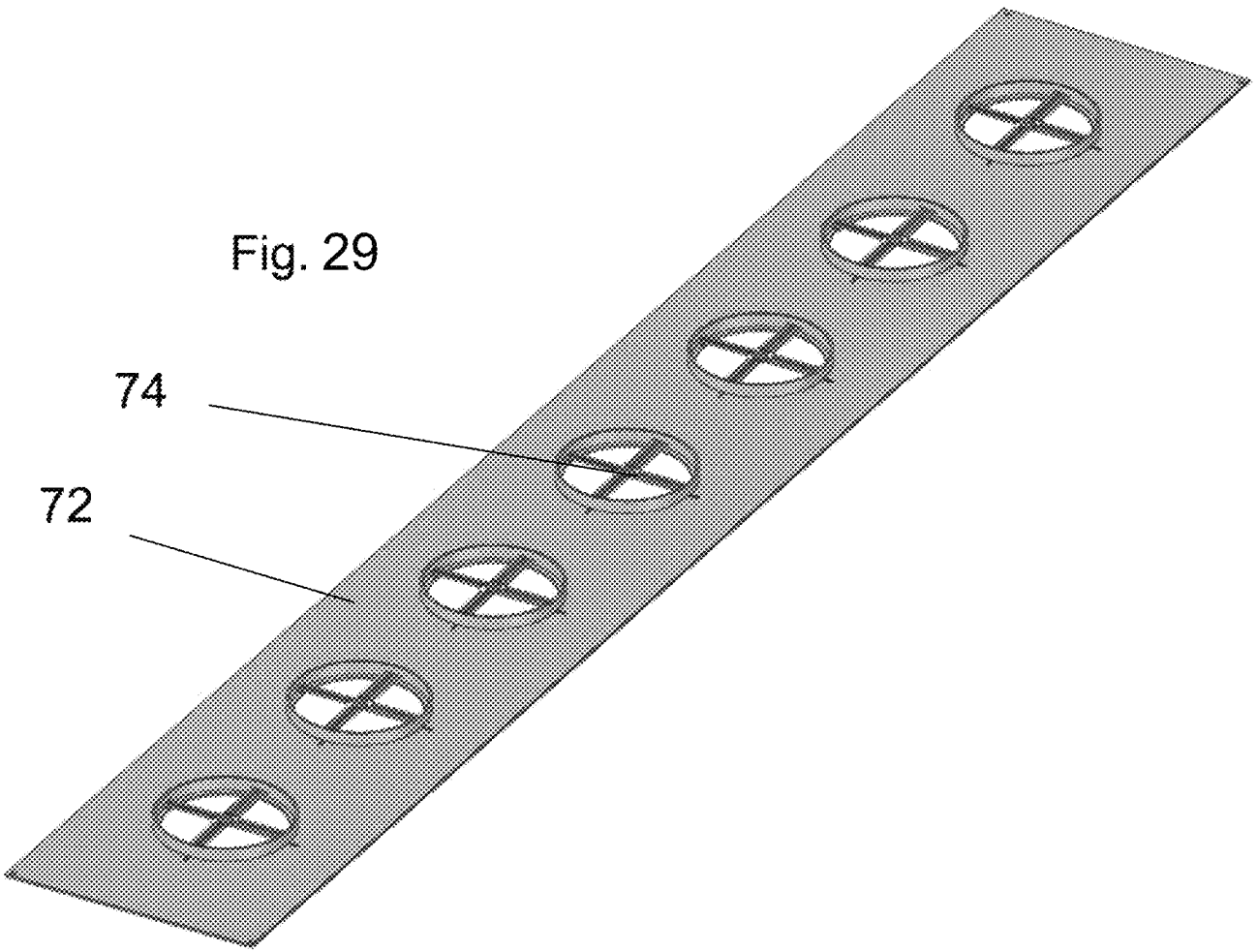
FIG. 29 is a representation of a fan deck plate according to an embodiment of the invention in which each plenum section module supports a plurality of fan deck plates, each fan deck plate supporting a plurality of fans.

The plenum section 64 for each ACC module 27, including the plenum section frame, fan deck supported on the plenum section frame, fan(s) and fan shroud(s), may be assembled at ground level with a single large fan, as shown, e.g., in FIGS. 13, 14, 17-22, 25 and 28, or it may be assembled (also at ground level) with a plurality of elongated fan deck plates 72, each supporting a plurality of smaller fans 74 in a row, as shown in FIGS. 29 and 30.

While the assembly described herein is described as being performed at grade, the assembly of the various modules may be performed at their final position if planning and construction schemes allow.

Every feature and alternative embodiment herein is intended and contemplated to work with and be used in combination of every other feature and embodiment described herein with the exception of embodiments with which it is incompatible. That is, each heat exchange module arrangement described herein, and each heat exchange panel arrangement described herein, and each tube type and each fin type described herein, each steam manifold arrangement described herein, and each fan arrangement, is intended to be used in various ACC assemblies with every combination of embodiments with which they are compatible, and the inventors do not consider their inventions to be limited to the exemplary combinations of embodiments that are reflected in the specification and figures for purpose of exposition.

The invention claimed is:

1. A large scale field erected air cooled industrial steam condenser connected to an industrial steam producing facility, comprising:

a condenser street comprising a row of condenser modules, each condenser module comprising a plenum section having a single fan or multiple fans drawing air through a plurality of heat exchanger panels supported in a heat exchanger section, and each heat exchanger panel having a longitudinal axis and a transverse axis perpendicular to its longitudinal axis;

each heat exchanger panel comprising a plurality of tubes, a top bonnet connected to and in fluid communication with a top end of each of said plurality of tubes, a bottom bonnet connected to and in fluid communication with a bottom end of at least a subset of said plurality of tubes, said bottom bonnet having a single steam inlet;

said condenser street further comprising a steam distribution manifold beneath said heat exchanger section and arranged along an axis that is perpendicular to longitudinal axes of said heat exchanger panels at midpoints of said heat exchanger panels and extending a length of said condenser street beneath said plurality of heat exchanger panels, said steam distribution manifold having at its top surface a plurality of connections, each of said plurality of connections adapted to connect to one or more of said single steam inlets;

wherein each heat exchanger panel comprises a primary condenser section, a secondary condenser section, and a top bonnet connected to and in fluid communication with a top end of each tube in said secondary condenser section and said primary condenser section, and each said top end of each said tube in said primary condenser section comprises an outlet flow orifice having a narrower area than a cross-sectional area of a corresponding each said tube in said primary condenser section, said bottom bonnet connected to and in fluid communication with a bottom end of each tube in said primary condenser section, each heat exchange panel further comprising an internal secondary chamber inside the bottom bonnet connected to and in fluid communication with a bottom end of each tube in said secondary condenser section.

2. The large scale field erected air cooled industrial steam condenser according to claim 1, wherein each said outlet flow orifice has an area that is 50% or less of the cross-sectional area of said corresponding tube.

3. The large scale field erected air cooled industrial steam condenser according to claim 1, wherein said primary condenser tubes constitute greater than 90% of a surface area of the heat exchanger section and said secondary condenser tubes constitute less than 10% of said surface area of the heat exchanger section.

4. The large scale field erected air cooled industrial steam condenser according to claim 1, wherein the secondary condenser section is centrally located along said heat exchange panel and flanked at each end by primary condenser sections.

5. The large scale field erected air cooled industrial steam condenser according to claim 1, wherein said tubes have a cross-sectional width of 5.2-7 mm.

6. The large scale field erected air cooled industrial steam condenser according to claim 1, wherein said tubes have a cross-sectional width of 6.0 mm.

7. The large scale field erected air cooled industrial steam condenser according to claim 1, wherein said plurality of tubes in said heat exchanger panels have fins attached to flat sides of said tubes, said fins having a height of 9 to 10 mm, and spaced at 5 to 12 fins per inch.

8. The large scale field erected air cooled industrial steam condenser according to claim 1, wherein said plurality of tubes in said heat exchanger panels have fins attached to flat sides of said tubes, said fins having a height of 18 mm to 20 mm spanning a space between adjacent tubes and contacting adjacent tubes, said fins spaced at 5 to 12 fins per inch.

9. A method for reducing an amount of secondary condenser tubes in an ACC while reducing the outlet header pressure to minimize backflow, sweep non-condensable gases and prevent the formation of dead zones in primary condenser tubes, comprising using primary condenser tubes each having an outlet orifice having an area that is 50% or less of the cross-sectional area of a corresponding primary condenser tube.

* * * * *